US009193544B2

(12) United States Patent
Nakagawa et al.

(10) Patent No.: US 9,193,544 B2
(45) Date of Patent: Nov. 24, 2015

(54) SHEET STACKING DEVICE, SHEET FEEDING DEVICE AND IMAGE FORMING APPARATUS

(71) Applicant: CANON KABUSHIKI KAISHA, Tokyo (JP)

(72) Inventors: Tomohito Nakagawa, Kashiwa (JP); Hideki Kushida, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/445,469

(22) Filed: Jul. 29, 2014

(65) Prior Publication Data

US 2015/0042037 A1 Feb. 12, 2015

(30) Foreign Application Priority Data

Aug. 6, 2013 (JP) ..... 2013-162894
Feb. 28, 2014 (JP) ..... 2014-038069

(51) Int. Cl.
*B65H 1/04* (2006.01)
*B65H 1/26* (2006.01)

(52) U.S. Cl.
CPC ..... *B65H 1/04* (2013.01); *B65H 1/266* (2013.01); *B65H 2405/1115* (2013.01); *B65H 2405/11161* (2013.01); *B65H 2405/11162* (2013.01); *B65H 2405/11163* (2013.01); *B65H 2405/15* (2013.01)

(58) Field of Classification Search
CPC ..... B65H 1/04; B65H 1/08; B65H 1/20; B65H 31/00; B65H 31/08; B65H 31/10; B65H 2402/31; B65H 2405/11; B65H 2405/1111; B65H 2405/11162; B65H 2405/11163; B65H 2405/1117; B65H 2405/354
USPC ..... 271/148, 213
See application file for complete search history.

(56) References Cited

U.S. PATENT DOCUMENTS

| | | | | |
|---|---|---|---|---|
| 2,529,730 | A * | 11/1950 | Henares et al. | 271/148 |
| 5,455,667 | A | 10/1995 | Hiroi et al. | |
| 5,552,859 | A | 9/1996 | Nakagawa et al. | |
| 7,874,553 | B2 | 1/2011 | Kushida et al. | |
| 8,550,461 | B2 | 10/2013 | Sekigawa et al. | |
| 8,651,480 | B2 | 2/2014 | Watanabe et al. | |
| 8,752,837 | B2 | 6/2014 | Iwata et al. | |
| 8,827,262 | B2 * | 9/2014 | Itabashi et al. | 271/148 |
| 2004/0036207 | A1 * | 2/2004 | Lee et al. | 271/157 |
| 2008/0079212 | A1 * | 4/2008 | Qi et al. | 271/8.1 |

FOREIGN PATENT DOCUMENTS

| | | | |
|---|---|---|---|
| JP | 6231623 A | * | 2/1987 |
| JP | 2110026 A | * | 4/1990 |
| JP | Hei 11-35175 A | | 2/1999 |

* cited by examiner

*Primary Examiner* — David H Bollinger
(74) *Attorney, Agent, or Firm* — Fitzpatrick, Cella, Harper & Scinto

(57) ABSTRACT

A sheet stacking device includes a base member and a sheet stacking portion on which a sheet is stacked. The sheet stacking portion is supported by the base member swingably in a first direction orthogonal to a second direction, and swings and changes an inclination angle for holding the stacked sheet.

18 Claims, 15 Drawing Sheets

SHEET STACKING DEVICE, SHEET FEEDING DEVICE AND IMAGE FORMING APPARATUS

BACKGROUND OF THE INVENTION

1. Field of the Invention

The present invention relates to a sheet stacking device, a sheet feeding device, and an image forming apparatus including the same.

2. Description of the Related Art

In a case of forming an image on an envelope whose sealing flap is folded and if a plurality of such envelopes is set while aligning with each other within a feed cassette, a height (thickness) of the envelopes on a side of a region where the flaps exist within the feed cassette becomes higher than a height of the envelopes on a side of a region where there is no flap. The more the number of stacked envelopes, the greater the difference of the heights becomes in this state, and an uppermost envelope is inclined remarkably.

FIG. 15 shows a state in which a plurality of envelopes P is set within a storage box 506 of the prior art sheet feeding device. As shown in FIG. 15, if the plurality of envelopes P is set such that the flaps are positioned in a direction orthogonal to a sheet feeding direction (a direction vertical to the sheet of FIG. 15), the envelopes P thus set are inclined. At this time, there is a case where a region $P_L$ side where there is no flap (referred to appropriately as a 'flap-less region $P_L$' hereinafter) of an uppermost envelope P is positioned below a wall surface 506*a* downstream in the sheet feeding direction of the storage box 506. If the envelope is fed in this state, there is a problem that the flap-less region $P_L$ of the envelope P abuts against the wall surface 506*a* downstream in the sheet feeding direction and the envelope P cannot be fed. Even if the flap-less region $P_L$ of the uppermost envelope P is not positioned below the sheet feeding downstream wall surface 506*a* of the storage box 506, there is a possibility of causing feeding failure because an area of contact with a feed roller 503 is reduced if the envelope P thus set is inclined.

With regard this problem, Japanese Patent Application Laid-open No. Hei. 11-35175 has proposed a sheet feeding device provided with an envelope pressing roller above set-up envelopes and configured to prevent an uppermost surface of the set-up envelope from inclining by pressing a region of the envelope where there is a flap, i.e., a bulge, by the envelope pressing roller.

However, because the sheet feeding device disclosed in Japanese Patent Application Laid-open No. Hei-11-35175 is configured to absorb a difference in a vertical direction between the bulge of the flap part of the sheet bundle (bundle of envelopes) and parts other than the flap part only by pressing by the roller, the set-up envelopes are tightened closely with each other and a friction force between the envelopes increases. Therefore, a conveyance load of the feed roller increases, possibly causing a feeding failure and others due to a slip of the feed roller.

SUMMARY OF THE INVENTION

According to a first aspect of the present invention, a sheet stacking device includes a base member and a sheet stacking portion on which a sheet is stacked. The sheet stacking portion is supported by the base member swingably in a first direction orthogonal to a second direction, and swings and changes an inclination angle for holding the stacked sheet.

Further features of the present invention will become apparent from the following description of exemplary embodiments (with reference to the attached drawings).

DESCRIPTION OF THE EMBODIMENTS

First Embodiment

An image forming apparatus of a first embodiment of the present invention will be described below with reference to FIGS. 1 through 11. The image forming apparatus of the embodiments of the invention is what includes a sheet feeding device configured to be able to feed a sheet, such as a copier, a printer, a facsimile, and a multi-function printer. As one example of the image forming apparatus, an electro-photographic type laser beam printer (referred to simply as a 'printer' hereinafter) 100 forming four color toner images will be exemplified in the following embodiments.

Figure 1:
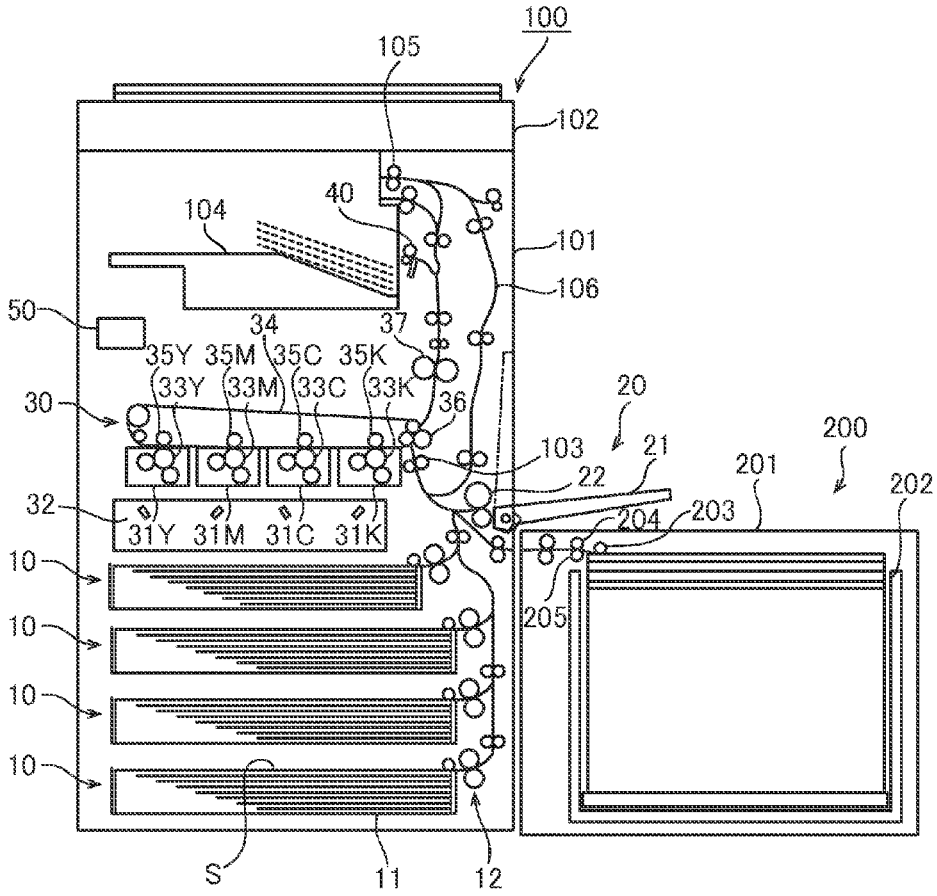
FIG. 1 is a section view schematically showing a printer of a first embodiment of the present invention.
Figure 2:
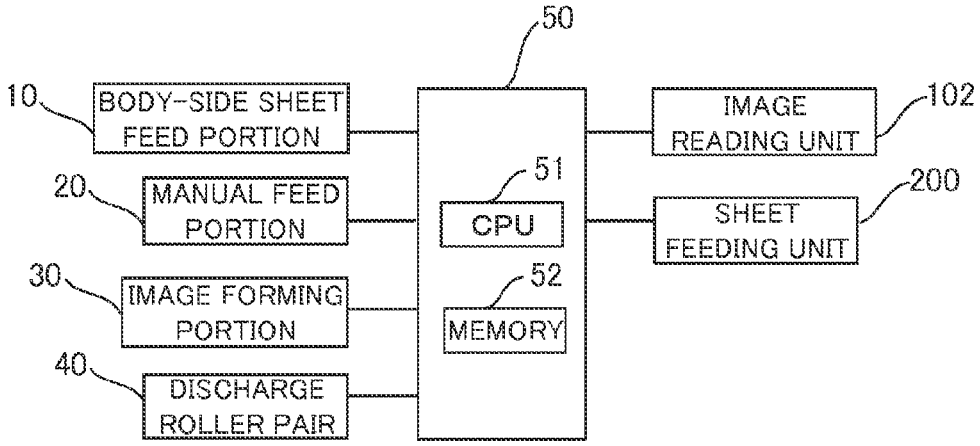
FIG. 2 is block diagram showing a configuration of a control portion of the printer of the first embodiment.

At first, a configuration of the printer 100 of the present embodiment will be schematically explained with reference to FIGS. 1 and 2. FIG. 1 is a section view schematically showing a printer 100 according to a first embodiment, and FIG. 2 is block diagram showing a configuration of a control portion 50 of the printer 100 of the present embodiment.

As shown in FIG. 1, the printer 100 includes a printer body 101, an image reading unit 102 configured to be able to read an image of a document, and a sheet feeding device 200 configured to be able to feed a sheet S to the printer body 101. The sheet feeding device 200 is configured such that it can be optionally attached to the printer body 101.

The printer body 101 includes a body-side sheet feed portion 10 feeding a sheet, a manual feed portion 20 configured to allow a sheet to be manually fed, an image forming portion 30 configured to be able to form an image on a sheet, a discharge roller pair 40 discharging the sheet on which the image has been formed out of the apparatus, and a control portion 50 controlling those units.

The body-side sheet feed portion 10 includes a fed sheet cassette 11 on which the sheet S to be fed is stacked and a feed portion 12 feeding the sheet S stacked on the fed sheet cassette 11 while separating one by one. Four stages of the body-side sheet feed portions 10 are provided in the present embodiment. The manual feed portion 20 includes a manual feed tray 21 on which a sheet S can be stacked and a manual feed portion 22 configured to be able to feed the sheet S stacked on the manual feed tray 21 to the printer body 101. The manual feed tray 21 is configured such that it can be stored in the printer body 101.

The image forming portion 30 includes four process cartridges 31Y, 31M, 31C, and 31K forming four color images of yellow (Y), magenta (M), cyan (C), and black (K). The image forming portion 30 also includes an exposure unit 32 exposing surfaces of photoconductive drums 33Y, 33M, 33C, and 33K described later. It is noted that because the four process cartridges 31Y through 31K are constructed in the same manner except of the colors of the images to be formed, only a configuration of the process cartridge 31Y will be explained and an explanation of the process cartridges 31M through 31K will be omitted here. The process cartridge 31Y includes the photoconductive drum 33Y, a charging roller charging the photoconductive drum 33Y, and a developing roller developing an electrostatic latent image formed on the photoconductive drum 33Y.

The image forming portion 30 also includes an intermediate transfer belt 34 on which toner images of the photoconductive drums 33Y through 33K are primarily transferred, and primary transfer rollers 35Y, 35M, 35C, and 35K primarily transferring the toner images on the photoconductive drums 33Y through 33K to the intermediate transfer belt 34. The image forming portion 30 also includes a secondary transfer portion 36 secondarily transferring the primarily transferred toner image to the sheet S and a fixing portion 37 heating and fixing the secondarily transferred toner image.

As shown in FIG. 2, the control portion 50 is connected with the body-side sheet feed portion 10, the manual feed portion 20, the image forming portion 30, the discharge roller pair 40, the image reading unit 102, the sheet feeding device 200, and others, and includes a CPU 51 controlling those members described above and a memory 52 storing various programs and various information.

The image reading unit 102 is disposed at an upper part of the printer body 101 and is provided above a discharge sheet stacking portion 104 described later through an intermediary of a discharge space above the discharge sheet stacking portion 104 formed above the printer body 101. It is noted that the image reading unit 102 is controlled by the control portion 50.

The sheet feeding device 200 is configured such that it can be removably attached to the printer body 101, and such that the sheet S stored therein can be fed to the printer body 101 by connecting it with the printer body 101. It is noted that the sheet feeding device 200 will be described later in detail.

Next, an image forming operation of the printer 100 (image forming control of the control portion 50) will be explained. In response to an input of image information from the image reading unit 102, an external personal computer or the like, the exposure unit 32 irradiates a laser beam to the photoconductive drum 33Y through 33K based on the inputted image information. At this time, the photoconductive drums 33Y through 33K have been charged in advance by the charging roller, and electrostatic latent images are formed on the photoconductive drum 33Y through 33K by the irradiation of the laser beam. The electrostatic latent images are developed by the developing rollers, and toner images of yellow (Y), magenta (M), cyan (C), and black (K) are formed on the photoconductive drum 33Y through 33K. The toner images of the respective colors formed on the photoconductive drum 33Y through 33K are superimposed and transferred sequentially to the intermediate transfer belt 34 by the primary transfer rollers 35Y through 35K. The four color toner images superimposed and transferred to the intermediate transfer belt 34 are conveyed by the intermediate transfer belt 34 to the secondary transfer portion 36.

In parallel with the image forming operation described above, the sheet S stacked in the fed sheet stacking portion 11 (referred to as a 'fed sheet cassette' hereinafter) is fed by the feed portion 12 one by one to the registration roller pair 103. Then, the registration roller pair 103 conveys the sheet S to the secondary transfer portion 36 with a predetermined conveying timing to transfer the toner images on the intermediate transfer belt 34. The sheet S on which the toner images have been transferred is conveyed to the fixing portion 37 to fix the toner images and is then discharged by the discharge roller pair 40 to and stacked on the discharge sheet stacking portion 104.

It is noted that in a case where images are to be formed on both surfaces of the sheet S, the sheet S in which the image has been formed on a first surface thereof is conveyed to a duplex conveying path 106 by a reverse conveying roller pair 105. The sheet S is then conveyed again to the image forming portion 30 through the duplex conveying path 106 to form an image on a second surface thereof.

Figure 3:
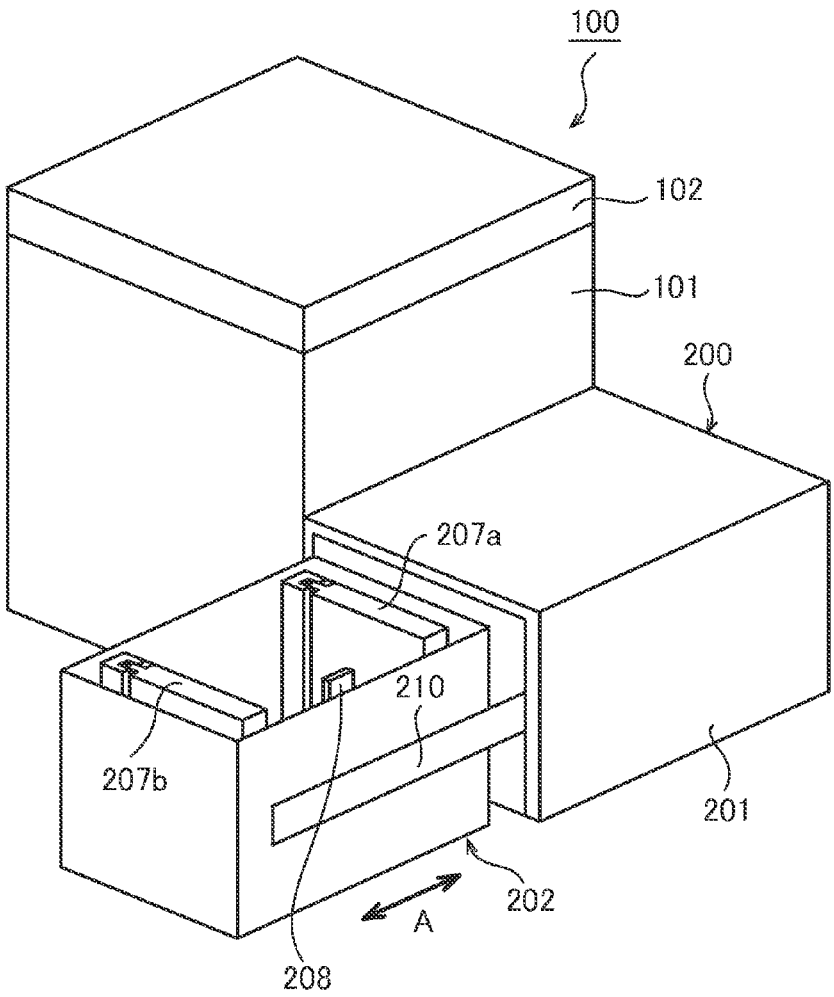
FIG. 3 is a perspective view schematically showing a sheet feeding device of the first embodiment.

Next, the sheet feeding device 200 described above will be specifically explained with reference to FIGS. 3 through 11. The sheet feeding device 200 is a large volume paper deck which is used by connecting to the printer body 101 in forming images on a large volume of sheets S. At first, a configuration of the sheet feeding device 200 will be schematically explained with reference to FIGS. 3 and 4. FIG. 3 is a perspective view schematically showing the sheet feeding device 200 of the present embodiment, and FIG. 4 is a section view schematically showing the sheet feeding device 200 of the first embodiment.

Figure 4:
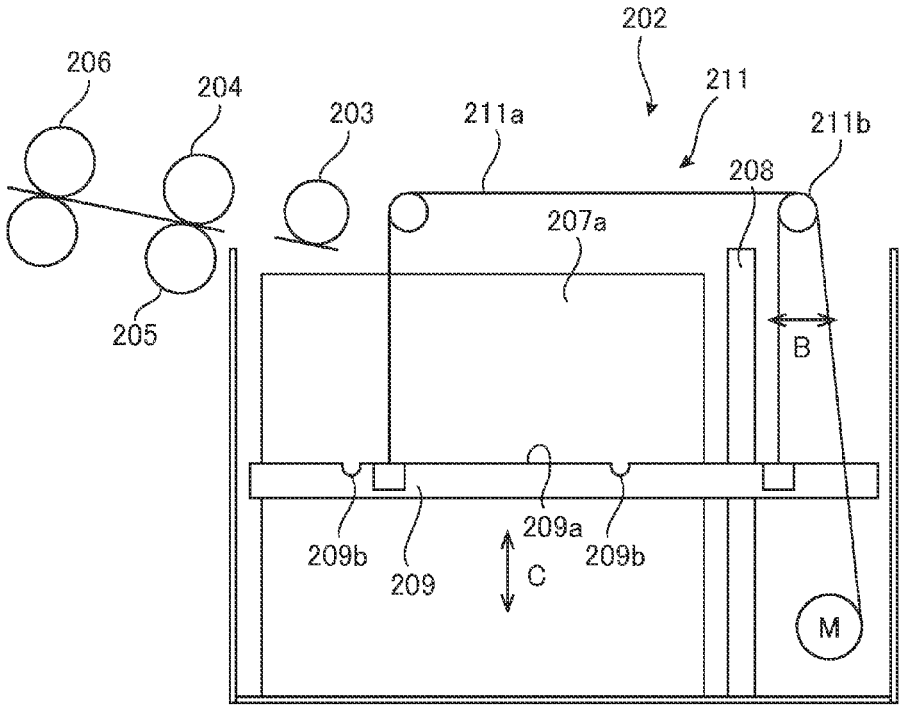
FIG. 4 is a section view schematically showing the sheet feeding device of the first embodiment.

As shown in FIGS. 3 and 4, the sheet feeding device 200 includes the feed unit body 201 removably attached to the printer body 101, a storage box 202 capable of storing a large volume of sheets S, and a feeding roller 203 sending out the sheet S stored in the storage box 202. The sheet feeding device 200 also includes a feed roller 204 and a retard roller 205 feeding the sheet S thus sent out while separating one by one, and a conveying roller 206 conveying the separately fed sheet S to the printer body 101.

The feed unit body 201 is configured such that it can be connected to the printer body 101 and such that the sheet feeding device 200 is controlled by the control portion 50 by connecting the feed unit body 201 to the printer body 101. That is, each component of the sheet feeding device 200 described later is controlled by the control portion 50.

A storage box 202 is configured such that it can be stored within the feed unit body 201 and such that it can be drawn out of the feed unit body 201 by a pair of side rails 210 provided at both sides thereof. In the present embodiment, the storage box 202 is provided with the pair of side rails 210 at upstream and downstream sides of the sheet feeding direction (direction indicated by an arrow D in FIGS. 4 and 5) and is configured such that it can be drawn out to one side of a width direction (directions indicated by an arrow A in FIG. 3) orthogonal to the sheet feeding direction.

The storage box 202 also includes side restricting plates (width direction restricting portion) 207*a* and 207*b* restricting a widthwise position of the sheet S orthogonal to the sheet feeding direction, and a rear-end restricting plate 208 located upstream in the sheet feeding direction and restricting a rear-end position of the sheet S. The storage box 202 also includes a tray (supporting portion) 209 capable of supporting the stored (stacked) sheet S and a lifter 211 lifting the tray 209.

As shown in FIG. 4, the lifter 211 includes a belt 211*a* linked to the tray 209, a pulley 211*b* around which the belt 211*a* is suspended, and a motor M winding the belt 211*a*. The tray 209 is moved in an upper direction (direction of an arrow C shown in FIG. 4) by winding the belt 211*a* by the motor M. An optional sheet feed portion composed of the feeding roller 203, the feed roller 204, and the retard roller 205, and the motor M may be controlled by the CPU 51 of the control portion 50. The tray 209 is disposed such that a support surface supporting (stacking) the sheet is substantially in a horizontal state. That is, the tray 209 can be lifted substantially in the horizontal condition by the lifter 211. While the lifter 211 is configured such that the belt 211*a* is unwound when the tray 209 drops by its own weight, the lifter 211 may be configured such that the belt 211*a* is unwound by the motor M. It is also noted that while a drive portion of the sheet feeding device 200 is controlled by the control portion 50 provided in the printer 100, it is also possible to dispose a CPU in the sheet feeding device 200 and to control the drive portion of the sheet feeding device 200.

The side restricting plates 207*a* and 207*b* are supported in the storage box 202 so as to be movable in the width direction orthogonal to the sheet feeding direction and are configured to abut against widthwise both ends of the sheet S to restrict widthwise position of the sheet S. The rear-end restricting plate 208 is supported in the storage box 202 so as to be movable in a direction (direction of an arrow B shown in FIG. 4) in parallel with the sheet feeding direction and is configured to abut against an upstream end in the sheet feeding direction of the sheet S to restrict the rear-end position of the sheet S.

The feeding roller 203, the feed roller 204 and the retard roller 205 are rubber rollers around which highly frictional members such as rubber are wrapped and are arranged as follows. That is, in a case where the feeding roller 203 sends out a plurality of sheets S stored in the storage box 202 for example, the retard roller 205 blocks the sheet other than the uppermost sheet from being fed and the feed roller 204 feeds only the uppermost sheet.

Next, a sheet feeding operation (a sheet feeding operation under control of the control portion 50) performed by the sheet feeding device 200 will be explained. When the sheet feeding device 200 is connected to the printer body 101, the sheet feeding device 200 is electrically connected with the printer body 101 and the sheet feeding device 200 can be controlled by the control portion 50. At first, from this state, the storage box 202 is drawn out of the feed unit body 201 to set the sheet S on the tray 209 of the storage box 202 from above. A work space for setting the sheet S is assured by drawing the storage box 202 out of the feed unit body 201. After setting the sheet S on the tray 209, the side restricting plates 207*a* and 207*b* and the rear-end restricting plate 208 are adjusted to a sheet size to restrict a feed position of the sheet S.

When the storage box 202 in which the sheet S has been set is stored in the feed unit body 201, the lifter 211 starts to lift the tray 209 and the feeding roller 203 stops at a predetermined position to feed an uppermost sheet S on the tray 209. The feeding roller 203 is provided with a height detecting sensor which outputs a detection signal when the uppermost sheet S pushes up the feeding roller 203 to the predetermined position due to the lift of the tray 209. Thereby, the control portion 50 controls the lifter 211 and stops the tray 209, so that the uppermost sheet S is kept at the predetermined position where the sheet S can be fed.

After that, when the feed of the sheet S is started and height of an uppermost sheet is lowered, the tray 209 rises again and the feeding roller 203 stops at the predetermined position. The sheet S is fed to the printer body 101 while repeating such operations and when the feed of a specified number of sheets S is finished, the feeding roller 203 stops.

Figure 5:
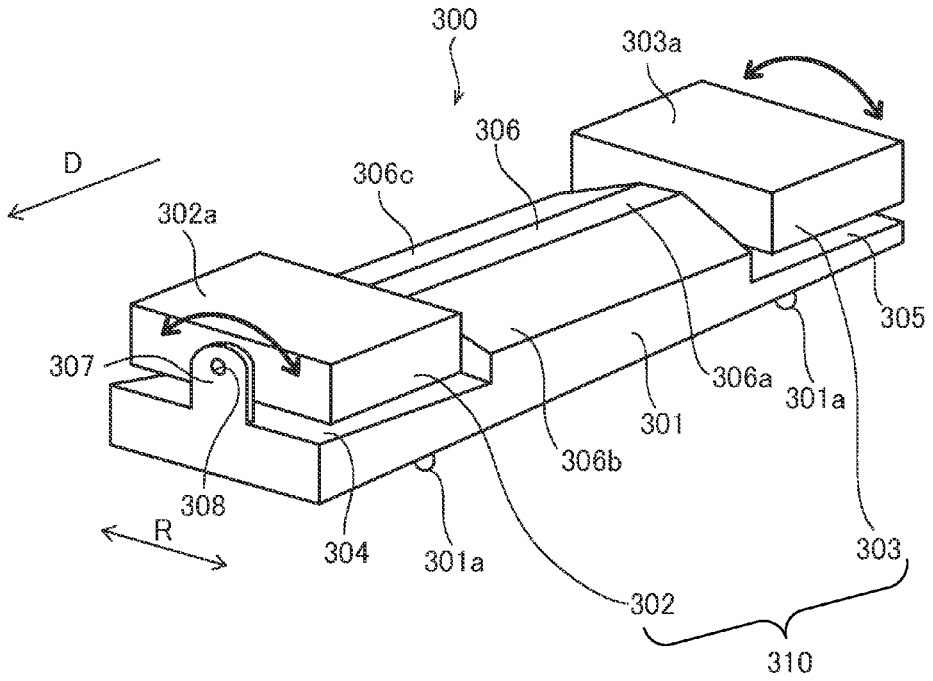
FIG. 5 is a perspective view showing a swinging stacking portion of the first embodiment.

Here, the sheet feeding device 200 is configured to be able to feed a sheet whose thickness is different, e.g., an envelope P provided with a flap, by using a removable swinging stacking portion 300. An operation of feeding an envelope P with a flap performed by using the swinging stacking portion 300 will be explained below with reference to FIGS. 5 through 11. At first, a schematic configuration of the swinging stacking portion 300 will be explained with reference to FIG. 5. FIG. 5 is a perspective view schematically showing the swinging stacking portion 300 of the present embodiment.

As shown in FIG. 5, the swinging stacking portion 300, i.e., a sheet stacking device, includes a swing base (base member) 301 which is attachable to the tray (sheet support portion) 209, and sheet stacking portion 310 on which a sheet is stacked. The sheet stacking portion 310 is swingably supported to the swing base 301. That is, the sheet stacking portion 310 is supported by the swing base 301 swingably in the width direction (first direction) orthogonal to the sheet feeding direction (second direction), and swings and changes an inclination angle for holding the stacked sheet. More specifically, the sheet stacking portion 310 include, respectively, a downstream side swing plate (first sheet stacking plate) 302 swingably supported by the swing base 301 and an upstream side swing plate (second sheet stacking plate) 303 arrayed with the downstream side swing plate 302 in the sheet feeding direction. In the present embodiment, the pair of sheet stacking plates is provided at upstream and downstream sides of the sheet feeding direction.

The swing base 301 is provided with a plurality of projections 301*a* at an under surface thereof such that the projections 301*a* can fit into a plurality of positioning holes 209*b* (see FIG. 4) formed on a sheet stacking surface 209*a* of the tray 209. The swing base 301 is positioned on and fixed to the sheet stacking surface 209*a* of the tray 209 by fitting the plurality of projections 301*a* into the plurality of positioning holes 209*b*. It is noted that the plurality of positioning holes 209*b* of the tray 209 is formed such that a longitudinal direction of the swing base 301 becomes substantially in parallel with the sheet feeding direction and is positioned under the feeding roller 203.

Formed on an upper surface side of the swing base 301 are depressions 304 and 305 formed at downstream and upstream sides in the sheet feeding direction and a crest portion 306 projecting upward between the depressions 304 and 305. A rib 307 projecting upward is formed at a downstream end in the sheet feeding direction of the depression 304, and a swing shaft 308 extending in parallel with the sheet feeding direction is fixed between the rib 307 and the crest portion 306. In the same manner, a rib not shown is formed at an upper stream end in the sheet feeding direction of the depression 305, and a swing shaft 309 (see FIGS. 7 through 9) extending in parallel with the direction in which the sheet is fed is fixed between the rib and the crest portion 306. The crest portion 306, i.e., an inclined portion, provided between the downstream and upstream swinging plates 302 and 303 in the sheet feeding direction includes, on an upper surface side thereof, a crest surface (apex portion) 306*a* having a surface in parallel with an axial direction of the swing shafts 308 and 309, and tapered (inclined) surfaces 306*b* and 306*c* inclined downward in the width direction from widthwise both ends of the crest surface 306*a*. In other words, the tapered surfaces 306*b* and 306*c* as first and second inclined surfaces are respectively inclined downward from the apex portion 306*a* in opposite widthwise directions. It is noted that although the crest portion 306 is provided with the tapered surfaces on the widthwise both sides from the crest surface 306*a* in the present embodiment, the crest portion 306 may be configured such that it includes an inclined surface inclined downward at least toward one side in the width direction. Still further, the depressions 304 and 305 of the swing base 301 and the crest surface 306*a* are formed such that they are inclined upward from upstream to downstream in the sheet feeding direction in the state in which the swing base 301 is positioned and fixed to the tray 209. That is, the swing base 301 is inclined as a whole such that height thereof increases from one end side (upstream end side) to another end side (downstream end side) in the sheet feeding direction.

The downstream and upstream swinging plates 302 and 303 are formed substantially into rectangular parallelepiped shapes and supported turnably respectively by the swing shafts 308 and 309. That is, the downstream and upstream swinging plates 302 and 303 are supported respectively by the swing base 301 with a predetermined distance from the depressions 304 and 305 swingably in the width direction (in a direction of an arrow R in FIG. 5) centering on the swing shaft 308 and 309. Therefore, the upper surfaces (stacking surfaces 302*a* and 303*a*) of the downstream and upstream swinging plates 302 and 303 are also inclined upward toward downstream in the sheet feeding direction in accordance to the inclination of the swing base 301, and the downstream swinging plate 302 is positioned at a level higher than that of the upstream swinging plate 303. When the envelope P is stacked on the upper surfaces of the downstream and upstream swinging plates 302 and 303, the level of the downstream side in the sheet feeding direction of the envelope P becomes higher than that of the upstream side in the sheet feeding direction of the envelope P. The downstream and upstream swinging plates 302 and 303 are swingable independently from each other, so that they may swing in a same direction in the width direction or may swing in different directions from each other.

Figure 6:
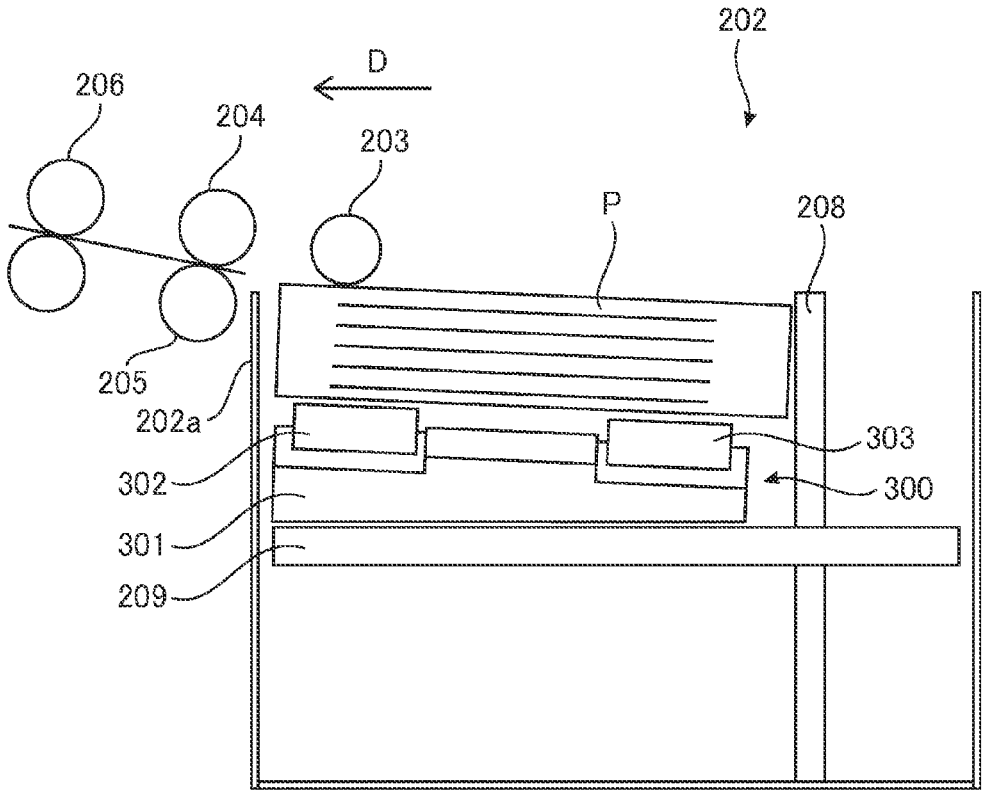
FIG. 6 is a section view of the envelopes stacked on the swinging stacking portion of the first embodiment seen from one side in a width direction thereof.
Figure 7:
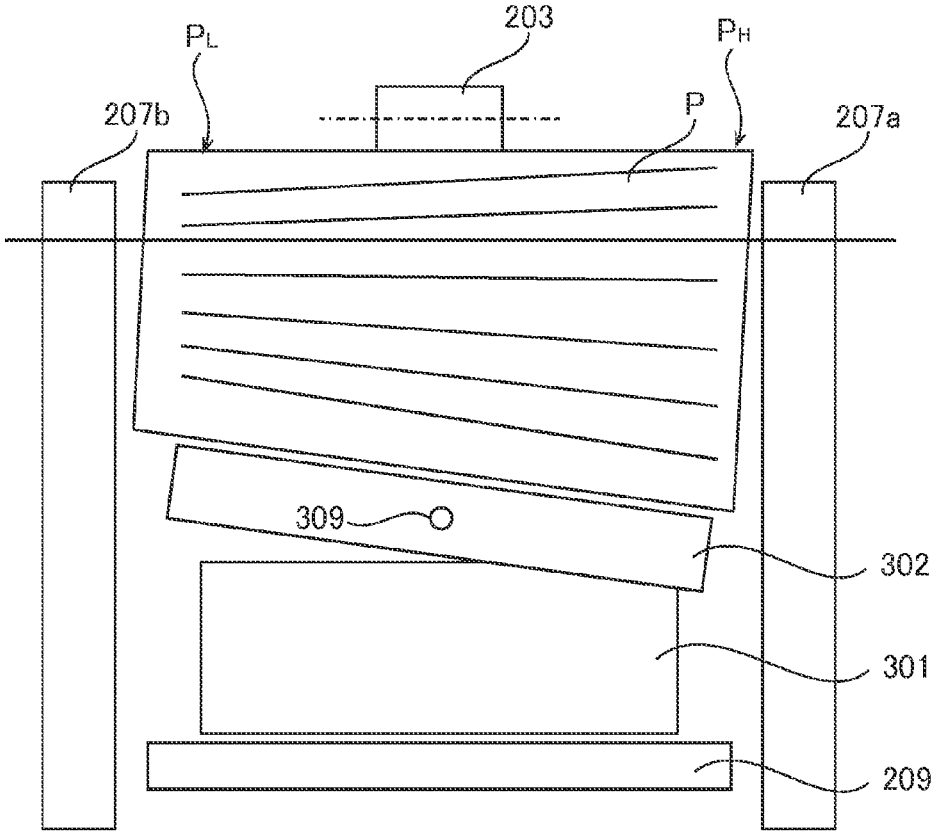
FIG. 7 is a section view of the envelopes stacked on the swinging stacking portion of the first embodiment seen from an upstream side of a sheet feeding direction.
Figure 8:
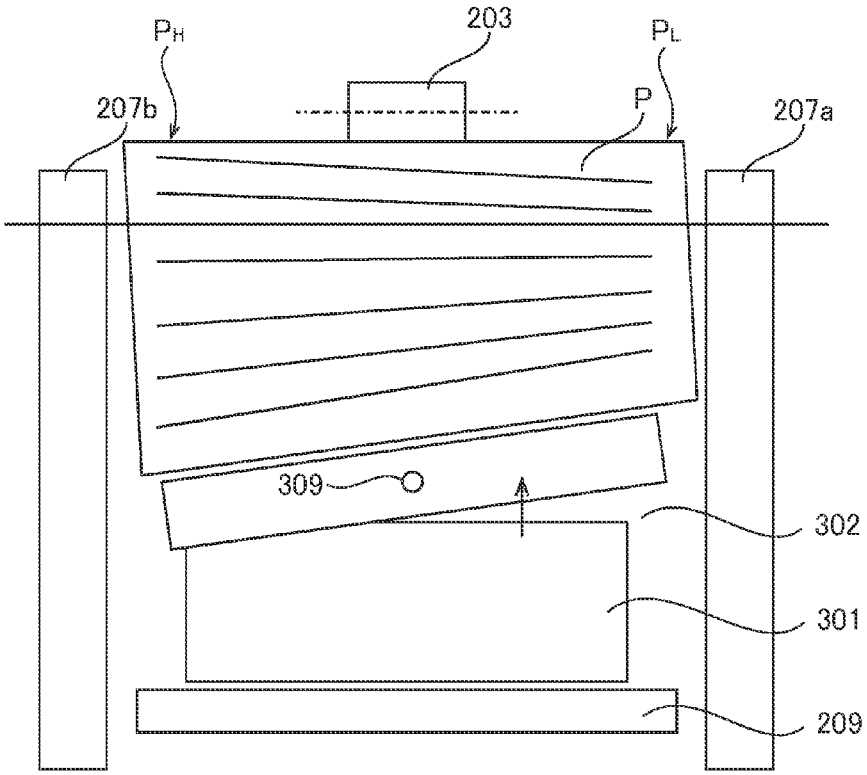
FIG. 8 is a section view of the envelopes stacked on the swinging stacking portion of the first embodiment seen from the upstream side of the sheet feeding direction.
Figure 9:
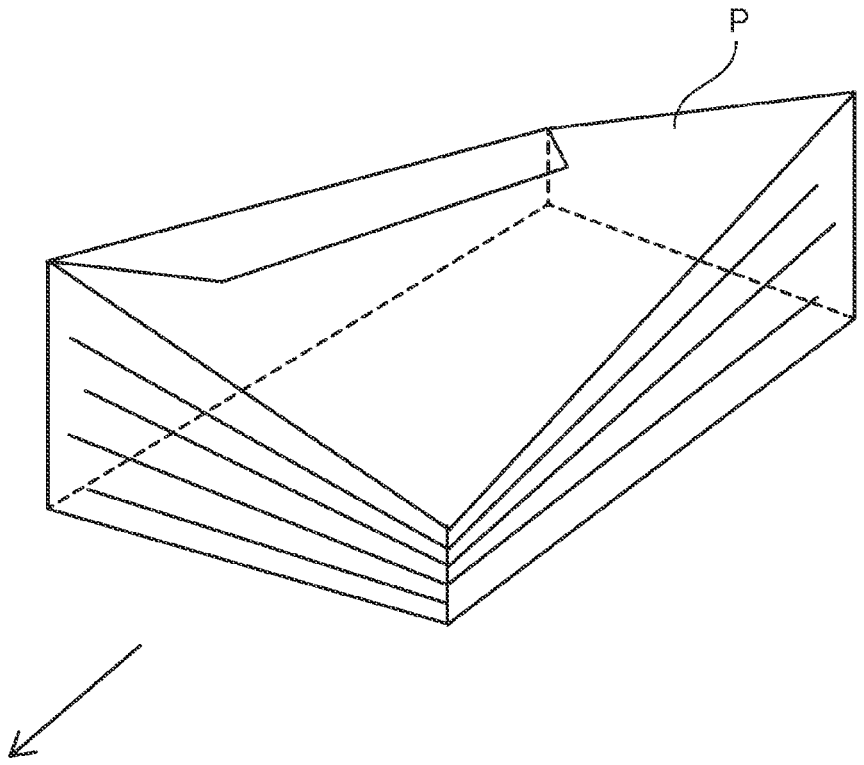
FIG. 9 is a perspective view showing a shape of a bundle of envelopes.
Figure 10:
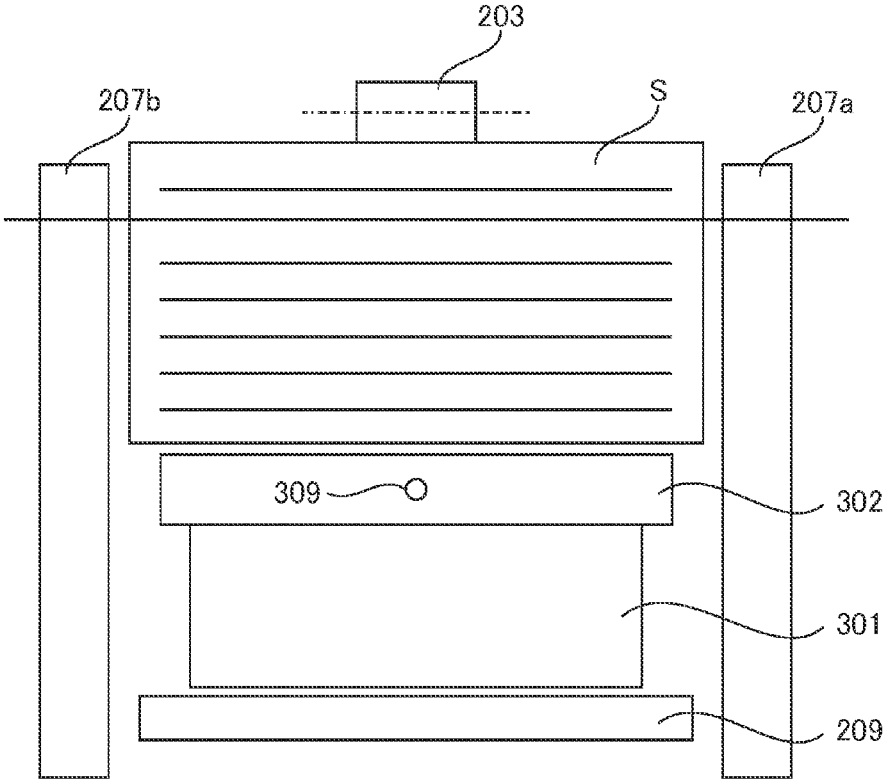
FIG. 10 is a section view of the sheets stacked on the swinging stacking portion of the first embodiment seen from the upstream side of the sheet feeding direction.
Figure 11:
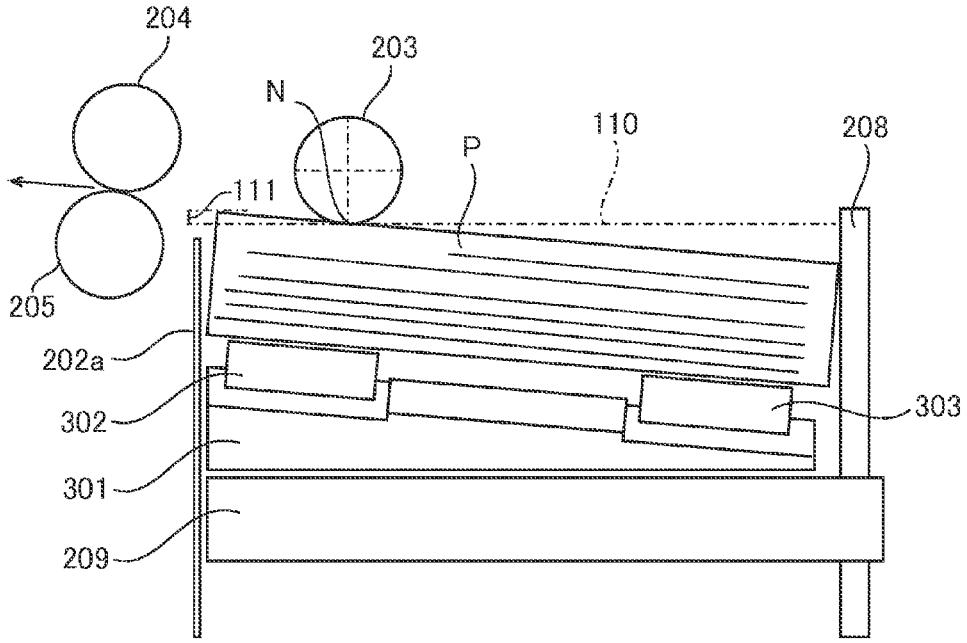
FIG. 11 is a section view illustrating an action performed on the envelopes stacked on the swinging stacking portion of the first embodiment.

Next, an operation performed when the envelope P is stacked on the swinging stacking portion 300 attached to the tray 209 will be explained with reference to FIGS. 6 through 11. FIG. 6 is a section view showing the envelopes P stacked on the swinging stacking portion 300 seen from one side in the width direction. FIG. 7 is a section view of the envelopes P stacked on the swinging stacking portion 300 seen from the upstream side of the sheet feeding direction. FIG. 8 is a section view of the envelopes P stacked on the swinging stacking portion 300 seen from the upstream side of the sheet feeding direction. FIG. 9 is a perspective view showing a shape of a bundle of envelopes. FIG. 10 is a section view of the sheets stacked on the swinging stacking portion 300 seen from the upstream side of the sheet feeding direction. FIG. 11 is a section view illustrating an action performed on the envelopes P stacked on the swinging stacking portion 300.

At first, the storage box 202 is drawn out of the feed unit body 201 and the swinging stacking portion 300 is attached to the predetermined position on the tray 209. Then, a plurality of envelopes P is set on the stacking surfaces 302*a* and 303*a* of the downstream and upstream swinging plates 302 and 303. After setting the plurality of envelopes P on the tray 209, the side restricting plates 207*a* and 207*b* and the rear-end restricting plate 208 are adjusted to the size of the envelopes to determine a feed position of the envelopes P.

When the storage box 202 in which the envelopes P have been set is stored in the feed unit body 201, the tray 209 starts to rise and the feeding roller 203 stops at a predetermined position for feeding an uppermost envelope P on the swinging stacking portion 300 as shown in FIG. 6. It is because the feeding roller 203 is provided with the height detecting sensor and the tray 209 is controlled to stop when the uppermost envelope P pushes up the feeding roller 203 to the predetermined position due to the rise of the tray 209.

Here, if a large number of ordinary envelopes P with flaps is piled up while being aligned in the same direction, a height (level) of a region of the envelopes P where there exit flaps becomes higher than that of a region of the envelopes P where there exist no flap. It is because a thickness of the envelopes P of the region where there exist the flaps is thicker than a thickness of the envelopes P where there exists no flaps, and the more the number of envelopes P is piled up, the more the thickness increases. If the difference of the heights of the stacked envelopes P becomes significant, an inclination of an upper surface of the upper most envelope P increases. If the inclination of the uppermost envelope P increases, a relative angle of an upper surface of the uppermost envelope P with respect to a roller surface of the feeding roller 203 increases, and if the relative angle increases, an area of contact of the feeding roller 203 with the uppermost envelope P decreases. If the area of contact decreases, a feeding force of the feeding roller 203 drops.

Meanwhile, when such envelopes P are stacked on the swinging stacking portion 300, the downstream and upstream swinging plates 302 and 303 swing centering on the swing shaft 308 and 309 by own weight of the envelopes P as shown in FIG. 7, and the region $P_H$ side where there exist the flaps (referred to as a 'flapped region $P_H$' hereinafter) drops with respect to the region where there exists no flaps (referred to as a 'flap-less region $P_L$' hereinafter). That is, the downstream and upstream swinging plates 302 and 303 make horizontal correction so as to absorb the difference of the heights on the upper surface of the envelope P between the flap-less region $P_L$ and the flap-less region $P_L$. This arrangement makes it possible to make the upper surface of the uppermost envelope P follow the roller surface of the feeding roller 203. Thus, this arrangement makes it possible to transmit the feeding force of the feeding roller 203 reliably to the upper surface of the envelope P and to reliably feed the envelope P. At this time, the envelope P is supported by the crest portion 306 in the region between the downstream and upstream swinging plates 302 and 303. Because the crest portion 306 has the tapered surfaces 306*b* and 306*c*, the envelope P is supported by the tapered surface 306*c* for example even if the downstream and upstream swinging plates 302 and 303 swing to the region $P_H$ side as shown in FIG. 7, and the envelope P is held stably.

It is noted that even if the upper surface of the uppermost envelope P is inclined slightly from the horizontal level, the envelope P is inclined as a whole when the roller surface of the feeding roller 203 comes into contact with the envelope P and the upper surface of the envelope P is substantially horizontalized. This arrangement makes it possible to make the roller surface come into contact with the upper surface of the envelope P uniformly in an axial direction of the feeding roller 203. Then, because a pressure of contact is uniformly applied to the upper surface of the envelope P in the axial direction, the envelope P can be fed stably without skewing the envelop P.

It is noted that even if the envelopes P are disposed reversely in the width direction (the flapped region $P_H$ is positioned on the side restricting plate 207*b* side) as shown in FIG. 8, it is possible to substantially horizontalize the upper surface of the uppermost envelope P as the downstream and upstream swinging plates 302 and 303 swing in an opposite direction from each other. Still further, there is a case where the heights of the regions vary in the width direction on the downstream and upstream sides in the sheet feeding direction depending on a shape of a bundle of the envelopes P as shown in FIG. 9 for example. Even if the bundle of envelopes P has such a shape, it is possible to substantially horizontalize the upper surface of the uppermost envelope P by alternately swinging the downstream and upstream swinging plates 302 and 303.

The downstream and upstream swinging plates 302 and 303 swing freely centering on the swing shafts 308 and 309 as described above, so that the flapped region $P_H$ naturally drops and the flap-less region $P_L$ rises even if the heights are extremely different due to the flaps of the envelopes P. Therefore, it is possible to keep the uppermost envelope P horizontal in a well-balanced manner. Thereby, the uppermost envelope P comes into contact correctly with the feeding roller 203, and the feeding roller 203 can feed the envelope P without causing a slip with the envelope P. It is noted that the term 'horizontal' mentioned here also includes a state close to horizontal.

Still further, because the tray 209 rises and the uppermost envelope P is pressed against the feeding roller 203 in feeding the envelope P, the downstream swinging plate 302 under the feeding roller 203 is horizontally corrected reliably with respect to the feeding roller 203. Meanwhile, because the upstream swinging plate 303 can swing independently from the downstream swinging plate 302, the upstream swinging plate 303 is less influenced by the horizontal correction made by the feeding roller 203 which is pressed against the envelope P. That is, the upstream swinging plate 303 is horizontally corrected based on a shape of a bundle of the envelopes P stacked right above the upstream swinging plate 303. That is, the downstream swinging plate 302 is horizontally corrected such that the feed by the feeding roller 203 is stabilized, and the upstream swinging plate 303 is horizontally corrected so as to stably support the envelopes P. This arrangement makes it possible to stably stack the envelopes P effectively by dividing roles and tendencies of the downstream and upstream swinging plates 302 and 303.

Still further, because the uppermost envelope P is substantially horizontalized, the flap-less region $P_L$ in the width direction can be positioned above the downstream wall surface 202*a* in the sheet feeding direction of the storage box 202. This arrangement makes it possible to prevent the feeding failure otherwise from occurring by the flap-less region $P_L$ colliding against the downstream wall surface 202*a* in the sheet feeding direction.

Still further, as shown in FIG. 10, even in a case where sheets S having no difference in thickness in the width direction are stacked on the downstream and upstream swinging plates 302 and 303, it is possible to keep the uppermost sheet S substantially in a horizontal state as the sheets S automatically take a balance. That is, it is possible to reliably feed the normal sheet S even in a case where the normal sheets S are stacked on the swinging stacking portion 300.

Still further, because the swing base 301 is inclined upward toward the downstream side in the sheet feeding direction as shown in FIG. 11, the envelope P can be sent out smoothly toward the feed roller 204. Specifically, a feed height of the envelope P is controlled to be the predetermined height by lifting the tray 209 under the detection of the height of the feeding roller 203 as described above. Due to that, it is possible to raise an edge of an uppermost surface of the envelope P by a height 111 with respect to a horizontal line 110 with a reference point of a nip N between the feeding roller 203 and the envelope P by inclining the swing base 301.

Thus, the use of the swing base 301 which is inclined upward toward the downstream side in the sheet feeding direction enables to surpass the downstream wall surface 202*a* in the sheet feeding direction and to smoothly feed the envelope P.

It is noted that because the swinging stacking portion 300 is configured to be removable from the tray 209, the swinging stacking portion 300 may be detached from the tray 209 and a sheet may be stacked on the tray 209 in feeding the normal sheet S for example. It is possible to stack a larger amount of sheets S by removing the swinging stacking portion 300 from the tray 209.

As described above, it is possible to prevent the sheet feeding failure from occurring in the printer 100 of the present embodiment because the sheet is fed by attaching the swinging stacking portion 300 to the tray 209 in feeding the sheet whose thickness varies such as an envelope P.

Still further, because the structure of the swinging stacking portion 300 is simple and the swinging stacking portion 300 is configured to be used by attaching to the tray 209, it is possible to feed a sheet whose thickness varies such as the envelope P readily without increasing a cost.

Second Embodiment

Next, an image forming apparatus of a second embodiment of the present invention will be described with reference to FIGS. 12 through 14. It is noted that the second embodiment is different from the first embodiment only in that structures of the downstream and upstream swinging plates are different, so that the same components with those of the first embodiment may not be shown or may be denoted by the same reference numerals, and their explanation will be omitted.

Figure 12:
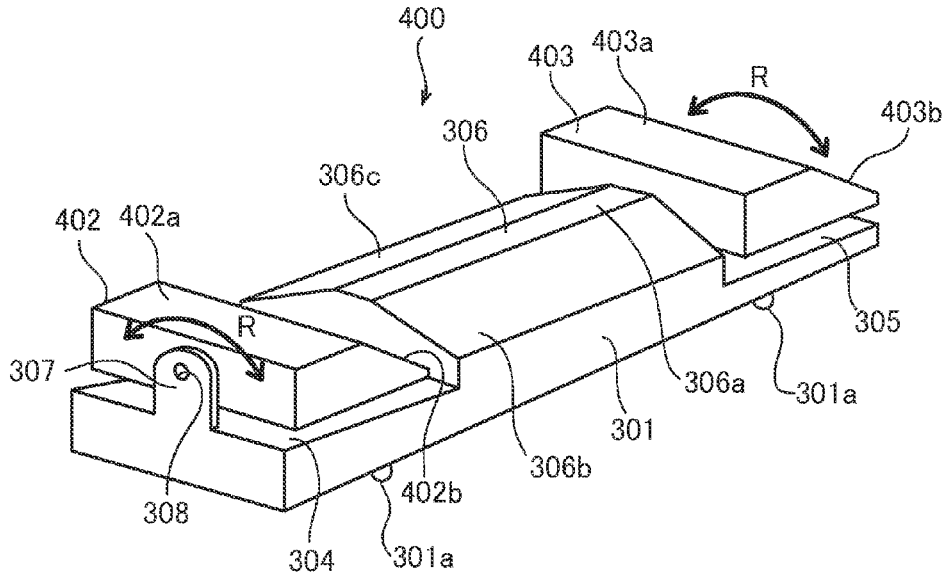
FIG. 12 is a perspective view showing a swinging stacking portion of a second embodiment.

FIG. 12 is a perspective view showing a swinging stacking portion of the present embodiment. FIG. 13 is a section view of envelopes stacked on the sheet stacking portion of the present embodiment seen from one direction in the width direction. FIG. 14 is a section view showing an operation of setting the envelopes on the sheet stacking portion seen from one side in the width direction.

Figure 13:
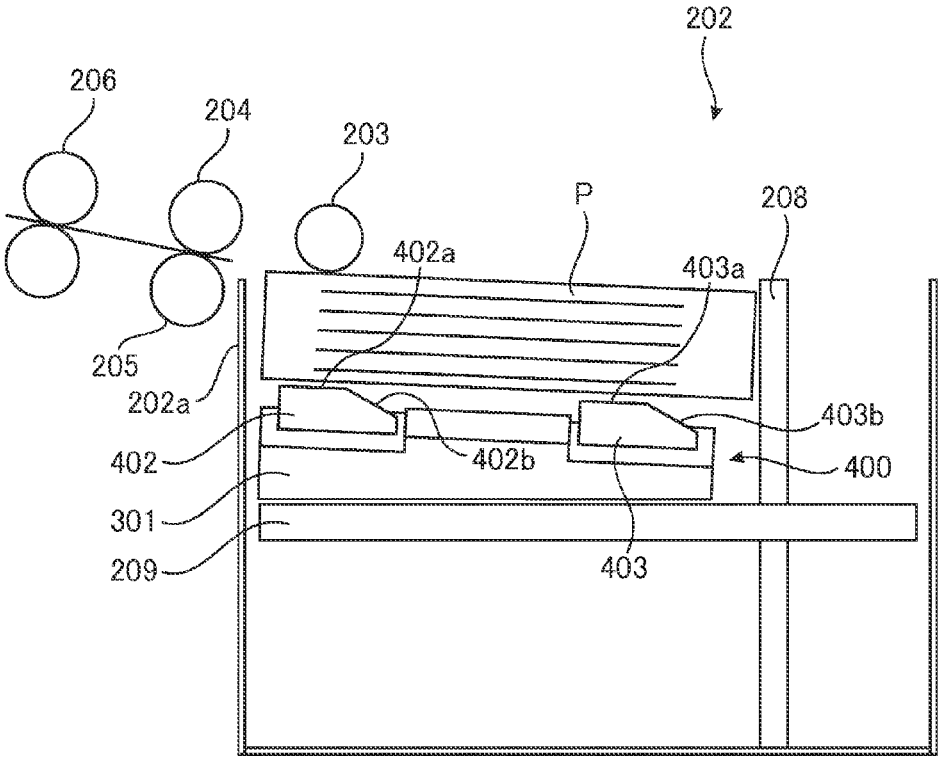
FIG. 13 is a section view of the envelopes stacked on the swinging stacking portion of the second embodiment seen from one side in the width direction thereof.

As shown in FIGS. 12 and 13, the swinging stacking portion 400 includes the swing base 301 attachable to the tray 209, downstream and upstream swinging plates 402 and 403 (sheet stacking plates) swingably supported by the swing base 301. The downstream swinging plate 402 includes a stacking surface 402*a* which is an upper surface thereof on which the envelopes P or the sheets S is stacked and an inclined surface 402*b* inclined downward from the upstream end portion in the sheet feeding direction of the stacking surface 402*a* toward the upstream in the sheet feeding direction. The upstream swinging plate 403 is constructed in the same manner with the downstream swinging plate 402 and includes a stacking surface 403*a* and an inclined surface 403*b*. The stacking surfaces 402*a* and 403*a* are formed such they are inclined upward to the downstream in the sheet feeding direction in a state in the swinging stacking portion 400 is positioned on and fixed to the tray 209.

In stacking the envelopes P on the swinging stacking portion 400 positioned on and fixed to the tray 209, there is a case where the side restricting plates 207*a* and 207*b*, and the rear-end restricting plate 208 are adjusted to sizes of the envelopes P in advance for example and where the envelopes P are inserted therein from above However, there is a case where it is difficult to insert the envelopes P from right above the tray 209 because the storage box 202 in which the tray 209 is stored is drawn out of the feed unit body 201 in use and because a top plate of the feed unit body 201 hinders the insertion of the envelopes P. Still further if the side restricting plates 207*a* and 207*b* and the rear-end restricting plate 208 are adjusted to the size of the envelope P in advance, there is no enough space which enables a user to hold the envelopes P in setting the envelopes P.

Figure 14:
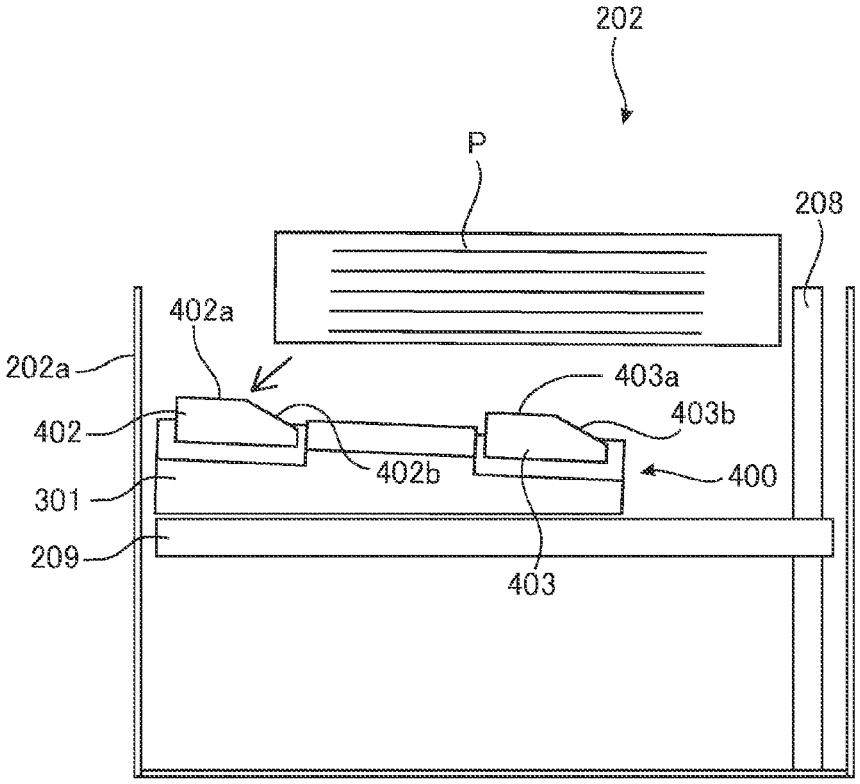
FIG. 14 is a section view illustrating an operation in setting the envelopes on the swinging stacking portion of the second embodiment.
Figure 15:
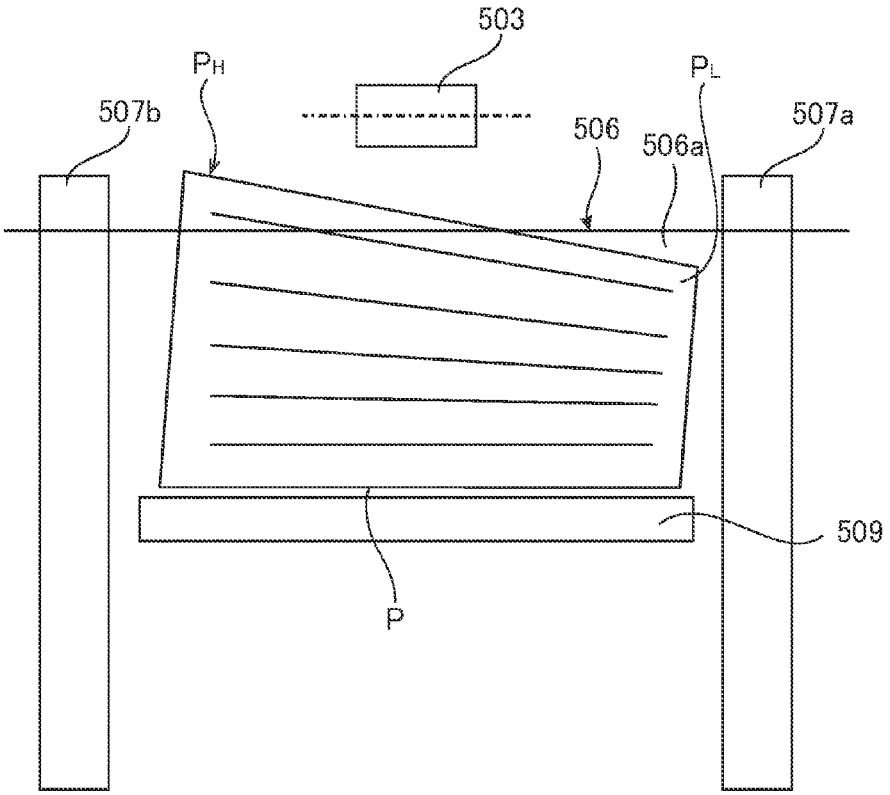
FIG.15 PRIOR ART
FIG. 15 is a section view showing a state in which envelopes are set within a prior art feed cassette.

Then, as shown in FIG. 14, it is conceivable to arrange such that the side restricting plates 207*a* and 207*b* (not shown in FIG. 14) are adjusted to the widthwise size of the envelope P in advance and the rear-end restricting plate 208 is adjusted to maximum stackable sheet size and to insert the envelopes P in such a state. In this case, the envelopes P are inserted to the swinging stacking portion 400 while moving from upward to downward from the upstream in the sheet feeding direction to the downstream in the sheet feeding direction. At this time, the user holds the envelopes P by the upstream end in the sheet feeding direction for example. Because a widthwise height changes as the downstream swinging plate 402 and the upstream swinging plate 403 swing centering on the swing shafts 308 and 309, an end of the envelopes P is tend to be caught by the downstream and upstream swinging plates 402 and 403 in setting the envelopes P obliquely from the upstream in the sheet feeding direction. However, the downstream and upstream swinging plate 402 and 403, i.e., the sheet stacking portion, have the inclined surfaces 402*b* and 403*b* respectively inclined in the sheet feeding direction at an end portion (one end portion) positioned on the upstream side in the sheet feeding direction in the present embodiment. That is, the downstream swinging plate 402 as the first sheet stacking plate has the inclined surface 402*b* inclined toward the sheet feeding direction at an end portion thereof positioned on the crest portion 306 side of the swing base 301, and the upstream swinging plate 403 as a second sheet stacking plate has an inclined surface 403*b* inclined in the sheet feeding direction at an end portion on a side opposite from the crest portion 306 of the swing base 301. Due to that, the swinging stacking portion 400 permits to stack the envelopes P steadily while preventing the end portion of the envelopes P from being caught by the inclined surfaces 402*b* and 403*b*. The setting of the envelopes P is completed by adjusting the rear-end restricting plate 208 to the size of the envelopes P after stacking the envelopes P to the swinging stacking portion 400. It is noted that the side restricting plates 207*a* and 207*b* may be adjusted to the widthwise size of the envelopes P after stacking the envelopes P.

There is also a case of placing the envelopes P on the upstream swinging plate 403 and of setting the envelopes P in this state while sliding on the swinging stacking portion 400 by adjusting the rear-end restricting plate 208 to the size of the envelopes P. Because the downstream and upstream swinging plates 402 and 403 have the inclined surfaces 402*b* and 403*b*, respectively, also in this case, it is possible to set the envelopes P while smoothly sliding the envelopes P. Still further, it is possible to set the envelopes P while smoothly sliding the envelopes P by setting the upstream end in the sheet feeding direction of the inclined surface 402*b* to be lower than the apex surface 306*a* of the crest portion 306, i.e., by forming such that the height of the apex portion 306*a* of the crest portion 306 is positioned within a range of height of the inclined surface 402*b* of the downstream swinging plate 402.

While the first and second embodiments of the present invention have described, the present invention is not limited to the above-mentioned embodiments. The effects described in the embodiment of the present invention are merely enumeration of the most preferable effects brought about from the present invention, and the effects of the present invention are not limited to those described in the embodiments of the present invention.

For example, while the swinging stacking portion 300 is used as an attachment removably attached to the storage box 202 in the first embodiment, the present invention is not limited to such a configuration. The swinging stacking portion 300 may be integrated with the tray 209, and the same effects may be brought about even if the sheet feed unit has the storage box in which the swinging stacking portion is integrated with the tray.

Still further, while the first embodiment has described by attaching the swinging stacking portion 300 to the storage box 202 of the sheet feed unit 200, the present invention is not limited to such configuration. For example, the swinging stacking portion 300 may be attached to the body-side sheet feed portion 10 of the printer body 101, and what in which the sheet stacking portion is integrated with the feed sheet cassette may be used as the body-side sheet feed portion 10. In the same manner, the swinging stacking portion 300 may be attached to the manual feed tray 21 of the manual feed portion 20 and what in which the sheet stacking portion is integrated with the manual feed tray may be used as the manual feed portion 20. The same effects are brought about even if the sheet stacking portion is used as described above.

Still further, while the first embodiment has been described by using the swinging stacking portion 300 having the two swinging plates of the downstream and upstream swinging plates 302 and 303, the number of the swinging plates is not limited to two, but may be one or three or more.

While the first embodiment has been also described by using the swing base that causes the downstream and upstream swinging plates 302 and 303 to swing by own weight of the sheets, the present invention is not limited to such a configuration. For instance, it is possible to swing the downstream and upstream swinging plates 302 and 303 by using a driving source such as a motor and a solenoid. In this case, the motor or the solenoid is driven corresponding to a stacking amount of the sheets to cause the downstream and upstream swinging plates 302 and 303 to swing such that the uppermost sheet follow the roller surface of the feeding roller.

Still further, while the first embodiment has been explained by using a configuration of lifting the tray 209 by the winding unit to make a sheet come into contact with the feeding roller 203, the present invention is not limited to such a configuration. For instance, the present invention is applicable to a sheet feed unit configured to make a sheet come into contact with the feeding roller by swinging the feeding roller.

Still further, while the first embodiment has been explained by using the electro-photographic type image forming apparatus, the present invention is noted limited to such a case. For example, the present invention is applicable to an ink-jet type image forming apparatus of forming an image on a sheet by discharging ink droplets from a nozzle.

Still further, while the downstream and upstream swinging plates 302 and 303 are configured to be rotably supported respectively by the swing shafts 308 and 309 of the swing base 301 in the first embodiment, the swing shafts may be fixed to the downstream and upstream swinging plates 302 and 303. That is, it is possible to configure such that the swing shafts rotate together with the downstream and upstream swinging plates 302 and 303, and the swing shafts are rotatably supported by the swing base 301.

While the crest portion 306 is disposed between the downstream and upstream swinging plates 302 and 303 in the first embodiment, the present invention is not limited to such a configuration. For example, the crest portion 306 may be disposed on the downstream side in the sheet feeding direction of the downstream swinging plate 302 or the upstream side in the sheet feeding direction of the upstream swinging plate 303. The crest portion 306 may be formed so as not have the apex surface 306*a* and may be formed so as to incline downward from apex lines which are lines in parallel with the swing shafts 308 and 309 for example. Still further, the crest portion 306 may be formed so as to be symmetrical in the width direction and may be any shape as long as it is formed into a shape of a crest inclined downward in the width direction from the apex portion.

Still further, the inclined surfaces 402*b* and 403*b* of the downstream and upstream swinging plates 302 and 303 described in the second embodiment is not limited to be a flat surface and may be a curved surface. The inclined surface may be configured from a shape in which a plurality of flat planes or curved planes are combined.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-162894, filed on Aug. 6, 2013, and Japanese Patent Application No. 2014-038069, filed on Feb. 28, 2014, which are hereby incorporated by reference herein in their entirety.

What is claimed is:

1. A sheet stacking device comprising:

a base member;

a first sheet stacking portion which is swingably supported on the base member in a first direction; and a second sheet stacking portion which is swingably supported on the base member in the first direction and is arrayed with the first sheet stacking portion in a second direction orthogonal to the first direction, wherein the second sheet stacking portion is swingable independently from the first sheet stacking portion.

2. The sheet stacking device according to claim 1, wherein the base member includes an inclined portion between the first and second sheet stacking portions in the second direction and the inclined portion includes an inclined surface inclined in the first direction.

3. The sheet stacking device according to claim 2, wherein the first sheet stacking portion includes an inclined surface inclined toward the second direction at an end portion thereof which is positioned on the side of the inclined portion of the base member, and the inclined portion is formed such that a height of an apex portion thereof is positioned within a range of height of the inclined surface of the first sheet stacking portion.

4. The sheet stacking device according to claim 3, wherein the second sheet stacking portion includes an inclined surface inclined toward the second direction at an end portion thereof which is positioned on an opposite side from the inclined portion of the base member, and the base member is inclined such that a height thereof increases in the second direction from one end portion side where the second sheet stacking portion is provided toward another end portion side where the first sheet stacking portion is provided.

5. The sheet stacking device according to claim 1, wherein each of the first sheet stacking portion and the second sheet stacking portion includes an inclined surface inclined in the second direction at one end portion in the second direction.

6. The sheet stacking device according to claim 1, wherein the base member is inclined upward from one end portion side toward another end portion side in the second direction.

7. A sheet feeding device comprising:

a base member;

a first sheet stacking portion which is swingably supported on the base member in a first direction;

a second sheet stacking portion which is swingably supported on the base member in the first direction and is arrayed with the first sheet stacking portion in a second direction orthogonal to the first direction, the second sheet stacking portion being swingable independently from the first sheet stacking portion;

a liftable supporting portion supporting the base member;

a driving mechanism driving the liftable supporting portion; and a feed portion for feeding a sheet stacked on the first sheet stacking portion and the second sheet stacking portion.

8. The sheet feeding device according to claim 7, wherein the base member includes an inclined portion between the first and second sheet stacking portions in the sheet feeding direction and the inclined portion includes an inclined surface inclined to the width direction.

9. The sheet feeding device according to claim 7, wherein the base member includes a first inclined portion and a second inclined portion between the first and second sheet stacking portions in the sheet feeding direction, and the first and second inclined portions include an apex portion disposed at such a position in the width direction so as to overlap with a center of swing of the first and second sheet stacking portions when viewed from the sheet feeding direction and first and second inclined surfaces respectively inclined downward from the apex portion in opposite widthwise directions.

10. The sheet feeding device according to claim 9, wherein the first sheet stacking portion includes an inclined surface inclined upward from upstream to downstream in the sheet feeding direction at an end portion thereof which is positioned on the side of the inclined portion of the base member, and the inclined portion is formed such that a height of an apex portion thereof is positioned within a range of height of the inclined surface of the first sheet stacking portion.

11. The sheet feeding device according to claim 10, wherein the second sheet stacking portion includes an inclined surface inclined upward from upstream to downstream in the sheet feeding direction at an end portion positioned on a side opposite from the inclined portion of the base member, and the base member is formed such that it is inclined upward from upstream to downstream in the sheet feeding direction in a state in which the base member is placed on the supporting portion.

12. The sheet feeding device according to claim 11, wherein the driving mechanism is configured to be able to lift a surface supporting the base member of the supporting portion substantially in a horizontal state.

13. The sheet feeding device according to claim 7, wherein each of the first sheet stacking portion and the second sheet stacking portion includes an inclined surface inclined upward from upstream to downstream in the sheet feeding direction at an end portion positioned on a side distant from the feed portion in the sheet feeding direction.

14. The sheet feeding device according to claim 7, wherein the base member is formed such that it is inclined upward from upstream to downstream in the sheet feeding direction in a state in which the base member is placed on the supporting portion.

15. The sheet feeding device according to claim 14, wherein the driving mechanism is configured to be able to lift a surface supporting the base member of the supporting portion substantially in a horizontal state.

16. The sheet feeding device according to claim 7, further comprising: a widthwise restricting portion restricting both ends in the width direction of a sheet.

17. The sheet feeding device according to claim 7, wherein the base member is configured such that the base member is removably attached to the supporting portion.

18. An image forming apparatus comprising:

a sheet feeding device as set forth in claim 7; and an image forming portion configured to be able to form an image on a sheet fed by the sheet feeding device.

* * * * *